US010886085B2

(12) United States Patent
Jenz et al.

(10) Patent No.: US 10,886,085 B2
(45) Date of Patent: Jan. 5, 2021

(54) TEMPERATURE-CONTROLLED DEVICE FOR SWITCHING OFF A HEATING INSTALLATION

(71) Applicant: E.G.O. Elektro-Geraetebau GmbH, Oberderdingen (DE)

(72) Inventors: Christoph Jenz, Oberderdingen (DE); Martin Roth, Kraichtal (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 0 days.

(21) Appl. No.: 16/288,316

(22) Filed: Feb. 28, 2019

(65) Prior Publication Data

US 2019/0272964 A1 Sep. 5, 2019

(30) Foreign Application Priority Data

Mar. 1, 2018 (DE) ..... 10 2018 203 099

(51) Int. Cl.
*H01H 37/12* (2006.01)
*H01H 37/04* (2006.01)
(Continued)

(52) U.S. Cl.
CPC ..... *H01H 37/12* (2013.01); *H01H 37/02* (2013.01); *H01H 37/04* (2013.01); *H01H 37/36* (2013.01);
(Continued)

(58) Field of Classification Search
CPC ..... H01H 37/12; H01H 37/60; H01H 37/02; H01H 37/64; H01H 37/52; H01H 37/36; H01H 37/04; H01H 35/2635; H01H 35/24
(Continued)

(56) References Cited

U.S. PATENT DOCUMENTS 2,591,802 A * 4/1952 Garner ..... H01H 35/2607 337/311
3,848,211 A * 11/1974 Russell ..... F23N 5/206 337/64
(Continued)

FOREIGN PATENT DOCUMENTS

DE 1915583 U 5/1965
DE 2246177 A1 3/1974
(Continued)

OTHER PUBLICATIONS

European Patent Office, Search Report for European Patent Application No. 19154600.1, dated Jul. 8, 2019, 8 pages, Munchen, Germany.

*Primary Examiner* — Stephen S Sul
(74) *Attorney, Agent, or Firm* — Alston & Bird LLP

(57) ABSTRACT

A temperature-controlled device for switching off a heating device at a limit temperature has a thermo-mechanical temperature sensor device, a switch-off device, and manual reactivation means. The switch-off device has switching means which are activated by a trigger for switching off the heating device. The manual reactivation means have a movable handle and transmission means for transmitting a force of an operator for reactivating the switching means after switching off the heating device by the trigger. The transmission means have a click spring which at the beginning is in a basic position and, when an operating force acting on said click spring exceeds a certain limit force, clicks to a deflected position. Said click spring in the basic position enables reactivating or re-switching on, respectively, of the switching means. Said click spring in the deflected position releases so much movement path on the transmission means for the switching means that said switching means by the temperature sensor device and by
(Continued)

the switch-off device above the limit temperature are activatable and switchable by the trigger.

18 Claims, 7 Drawing Sheets

(51) Int. Cl.
*H01H 37/36* (2006.01)
*H01H 37/52* (2006.01)
*H01H 37/64* (2006.01)
*H01H 37/02* (2006.01)
*H01H 37/60* (2006.01)
*H01H 35/24* (2006.01)
*H01H 35/26* (2006.01)

(52) U.S. Cl.
CPC ..... *H01H 37/52* (2013.01); *H01H 37/60* (2013.01); *H01H 37/64* (2013.01); *H01H 35/24* (2013.01); *H01H 35/2635* (2013.01)

(58) Field of Classification Search
USPC ... 337/72, 77, 102, 107, 348, 358, 360, 362, 337/365, 367, 368, 377, 379
See application file for complete search history.

(56) References Cited

U.S. PATENT DOCUMENTS 3,885,222 A * 5/1975 Manecke ..... H01H 37/02 337/338
4,117,443 A * 9/1978 Hofsass ..... H01H 37/5409 337/348
4,214,136 A * 7/1980 Rossi ..... H01H 5/18 200/251
4,254,313 A * 3/1981 Baader ..... H01H 5/18 200/452
4,260,977 A 4/1981 Kicherer et al.
4,626,819 A * 12/1986 Drapeau ..... H01H 37/22 200/83 S
5,032,818 A * 7/1991 Zanon ..... H01H 37/10 337/319
5,157,370 A * 10/1992 Engelbach ..... H01H 37/5409 337/348
5,269,499 A * 12/1993 Schwab ..... F16F 1/322 200/290
5,270,799 A * 12/1993 Rose ..... H01H 37/5409 337/348
5,315,281 A * 5/1994 Mount ..... H01H 35/2607 337/312
5,854,585 A * 12/1998 Kingma ..... H01H 37/5409 337/367
6,064,294 A * 5/2000 Schwarze ..... H01H 37/38 337/321
9,959,987 B2 * 5/2018 Tanaka ..... H01H 9/0271

FOREIGN PATENT DOCUMENTS

DE 2745548 A1 3/1979
EP 0005191 A1 11/1979

* cited by examiner

TEMPERATURE-CONTROLLED DEVICE FOR SWITCHING OFF A HEATING INSTALLATION

CROSS-REFERENCE TO RELATED APPLICATIONS

This application claims priority from German Application No. 10 2018 203 099.5, filed Mar. 1, 2018, the contents of which are hereby incorporated herein in its entirety by reference.

BACKGROUND

The invention relates to a temperature-controlled device for switching off a heating device at a limit temperature, wherein the device has manual reactivation means as a type of reset, or for re-switching on after switching off.

A device of this type in a simple form as a limiter for being able to switch off a heating device at a limit temperature is known from DE 2246177 A1. Said switching off in the first aspect is then intended to be permanent in such a manner that no automatic re-switching on is performed when the temperature drops below the limit temperature. This thus serves for enhancing the safety of an operation of the heating device and not for regulating to a specific temperature which is to be adhered to as precisely as possible.

However, in order for the heating device in this instance to be able to continue to be operated, in the case of a refinement it is possible for an operator to push a button, or to generally move or activate a handle, so as to enable the re-switching on of the switching means, or the continuing operation of the heating device, respectively. This in mechanical or thermo-mechanical terms, respectively, quasi corresponds to the electric behavior of an electrical circuit-breaker which after having been tripped can be manually closed again by throwing a lever.

BRIEF SUMMARY

The invention is based on the object of achieving a temperature-controlled device mentioned at the outset, by way of which issues of the prior art can be solved and it is in particular possible for the reactivation means for reactivating, or re-switching on, respectively, once more the switching means to be embodied in a practicable and at the same time reliable manner.

Said object is achieved by a temperature-controlled device having the features of claim 1. Advantageous and preferred design embodiments of the invention are the subject matter of the further claims and will be explained in more detail hereunder. The wording of the claims by way of explicit reference is incorporated in the content of the description.

The temperature-controlled device has a thermo-mechanical temperature sensor device, a switch-off device, and manual reactivation means. The temperature sensor device has a thermo-mechanical temperature sensor such as is known above all from the prior art, and a trigger. The thermo-mechanical temperature sensor can be rod-shaped from elements having dissimilar coefficients of expansion, or be a hydraulic system having a line which has liquid or oil, respectively, having a specific coefficient of temperature pertaining to the expansion or volume, respectively. A specific expansion of the thermo-mechanical temperature sensor is performed as a function of a temperature detected, said specific expansion acting on the trigger. The trigger can then, specifically directly or indirectly, activate and switch switching means which are provided in the switch-off device. The heating device can thus be switched off at the limit temperature, wherein the limit temperature can be set by an operator as a settable temperature limit. Alternatively, said limit temperature can advantageously be predefined ex-works. The switching means are furthermore configured for installation, or incorporation, respectively, in the path of an energy supply to the heating device, and in practice are contained, conjointly with the device, in the energy supply to said heating device such that said switching means can now switch off the heating device, or can separate said heating device from the energy supply, respectively, when the limit temperature is reached.

The manual reactivation means have a movable handle for transmitting a force, a so-called operating force, of an operator, so as to be able to reactivate or re-switch on, respectively, the switching means after the switching-off of the heating device by the trigger. As has been mentioned at the outset, an operator, when present and upon identifying the switching-off of the heating device, should thus have the possibility of being able to perform a brief check of the state of the heating device, or of an apparatus comprising the heating device. In the absence of any obvious serious fault, the operator by way of the movable handle, or by moving or depressing the handle, respectively, can reactivate or re-switch on, respectively, the switching means such that the heating device can again heat. Transmission means between the handle and the switching means which are connected in a force-transmitting manner to the handle are furthermore provided. The handle acts in particular by way of the transmission means on the switching means.

It is provided according to the invention that the transmission means have a click spring which in the line of an operating force that acts thereon from the handle, up to a certain or predefined limit force, is in a basic position which is or forms a first position. This means that the click spring is in direct prolongation of the operating force, which runs in a direction through the click spring, or that the operating force directly acts upon the click spring.

When the operating force acting on said click spring exceeds the limit force, or is larger than said limit force, respectively, the click spring clicks from the basic position to a deflected position which is a second position of the click spring. The click spring preferably has only these two positions, thus at all times attempts to return from the deflected position back to the basic position, such that said click spring is quasi monostable. The restoring force by way of which the click spring attempts to return from the deflected position back to the basic position herein can be lower than the limit force which is required for pushing the click spring from the basic position to the deflected position, thus for making the click spring click. The limit force is advantageously greater by 20% to 500%, particularly advantageously greater by 75% to 200%, than the restoring force.

The click spring in the basic position reactivates the switching means, or re-switches on said switching means, respectively, or enables said switching means to be re-switched on. This is performed above all by way of a direct force transmission. The click spring in the deflected position releases so much movement path on the transmission means for the switching means that the switching means by the temperature sensor device and by the switch-off device at a temperature above the limit temperature are activatable and can again be switched by the trigger. Renewed switching-off of the heating device can be performed on account thereof.

It can in particular be achieved that the transmission means for such switching-off of the heating device do not block or prevent switching even in the case of a depressed handle. To this end, it can be advantageously provided that a type of path limiter or detent is provided on the handle in such a manner that the handle therefor by way of detent means can only be moved relative to the device for a maximum movement path. This can be a compression detent which acts in particular against the housing of the device or against an aperture behind which the housing of the device can be assembled. Detent means of this type can be configured, for example, so as to be sleeve-like or in the manner of protrusions, and proceed from the handle towards the housing of the device, wherein said detent means can at least partially engage across the transmission means.

It is thus possible that any malfunction in which an operator by means of the handle reactivates or re-switches on, respectively, the switching means, and by way of permanently activating or depressing the handle then applies so much operating force that the trigger cannot overcome said operating force by way of a trigger force is prevented. Switching-off by way of the temperature sensor device would then no longer be possible, and a substantial safety function would be put out of operation. The click spring in the transmission means between the handle and the switching means can prevent this, in particular when the own limit force of said click spring for clicking lies below the trigger force. In the instance when the handle has been activated or depressed, respectively, by the operator, the transmission means can no longer block the switching of the switching device, or above all the switching-off by the trigger, respectively.

In an advantageous design embodiment of the invention the click spring can be configured so as to be planar and curved. Said click spring is advantageously curved in one direction, particularly advantageously uniformly curved, for example having a curvature height which is between 3% and 25% of the maximum or minimum diameter. Click springs of this type are in principle known to a person skilled in the art, for example also as a so-called clicker. Alternatively, a click spring can also be configured so as to be in an elongate shape, for example having one or two spring legs.

A click spring can particularly advantageously be composed of sheet metal, in particular suitable spring steel. The diameter of a planar click spring can be between 1 cm and 4 cm; a thickness can be between 0.01 mm and 1 mm.

The transmission means can be configured such that said transmission means have a pressure arm and a rocker. The rocker in turn has a bearing point about which said rocker can be pivoted. Said bearing point is advantageously disposed so as to be eccentric. The pressure arm is movably configured and fastened, said pressure arm in particular being movable or pivotable about a bearing at one end. The fastening of the pressure arm should advantageously be such that the handle by way of the operating force acts on said pressure arm so as to move the latter. The pressure arm, in particular by way of a free end which is opposite to the other end fastened to the device, can then push against the rocker on a first side of the bearing point of said rocker, when the device is to be reactivated, or the switching means are to be switched on again, respectively. The rocker on another, second side of the bearing point, by way of the movement of said rocker, or by the pivoting, respectively, then releases a movement path for the switching means such that the switching means can close again, this advantageously being performed in a self-acting manner as soon as the movement path has been released. The device can then enable the continuing operation of the heating device or the renewed operation of the heating device until the temperature sensor device, upon again reaching the limit temperature, again switches off the switching means by way of the trigger.

The rocker mentioned is advantageously configured so as to be bistable. Said rocker has a free position as a first position in which the switching means are not activated, or are not influenced by the rocker, respectively. There is advantageously no direct contact. By contrast, the switching means in a second position as a blocking position of the rocker are forcibly opened by the rocker such that the rocker keeps the switching means opened. This may be performed counter to a spring force mentioned, or a closing force of the switching means. The switching means advantageously have a sprung arm having a contact head which, on account of a spring force formed by said contact head itself, pushes against a counter contact when the switching means are closed. The contact head, counter to the spring force thereof, is pushed away from said counter contact when the rocker quasi forcibly opens the switching means.

The bistable configuration of the rocker can advantageously be achieved in that, in a manner known per se, a rocker spring bears on the rocker. The rocker is thus mounted in a quasi bistable manner having the two afore-mentioned positions between which said rocker, by virtue of the rocker spring bearing thereon, abruptly clicks. The rocker spring herein advantageously bears against the second side, or on the second side, respectively, of the rocker. A transition point up to which the rocker is in the first free position can be configured, and said rocker clicking to the second blocking position when said rocker has been moved beyond said transition point. This also progresses in the same manner in the opposite direction. Moving or triggering, respectively, of the rocker is advantageously either performed by the pressure arm, specifically preferably in the direction from the blocking position to the free position. The movement in the opposite direction is particularly advantageously caused by the trigger which in this instance acts on the other side of the bearing point of the rocker as the pressure arm, and moves the rocker from the free-position to the blocking position. The trigger can thus cause the opening, or the switching-off, respectively, of the switching means by the rocker.

The trigger can act directly on the rocker; in particular, said trigger can push said rocker from the free position to the blocking position, as has been described above. However, for a movement that is capable of improved control, a trigger lever on which the trigger acts in such a manner that an increasing deflection of the trigger lever is caused by the trigger as the temperature increases at the temperature sensor can also be provided. The trigger lever can above all be disposed between the trigger and the switching means. Said trigger lever can also cause a certain positive gearing of the path of the trigger with a view to a longer path, and alternatively a negative gearing with a view to a shorter path having a higher force. In a further advantageous design embodiment of the invention it is possible for the trigger lever to also be disposed between the trigger and the afore-mentioned rocker.

The bistable design embodiment of the rocker by way of triggering the switching means while activating the switching means has the advantage that the abrupt clicking of the rocker from the free position to the blocking position abruptly activates or opens, respectively, the switching means, in particular in the afore-described configuration. No sparking or contact fire can thus arise. This, however, is known per se from devices of this type for delimitation.

When, as has been described above, both the pressure arm, on which the operating force from the handle can act, as well as the trigger, by way of the triggering force exerted thereby, act on the rocker, it can be provided that a force path having a force transmission exists between the trigger and the handle. The click spring according to the invention can in this instance be disposed in said force path, or in said force transmission of the transmission means, respectively. Said force path, or the force transmission, respectively, can be directly form-fitting, with the exception of the click spring, or the movement path thereof between the basic position and the deflected position, respectively. This should apply at least when the afore-mentioned rocker is in the free position and the handle is activated in such a manner that the afore-mentioned pressure arm pushes against the rocker and the click spring is however still in the basic position.

The click spring is preferably configured in such a manner that the afore-mentioned limit force is less than the triggering force which has been generated by the trigger at a temperature increase, advantageously at a temperature increase beyond the limit temperature, in particular when the trigger by virtue of the temperature increase has traveled a path between 0.5 mm and 3 mm, in particular approximately 1 mm. It can thus be provided, for example, that the trigger has a force generation between 20 N/mm and 60 N/mm. A limit force in this instance can be approximately 50 N. This means that when the click spring is in the basic position, an operator by way of approx. 50 N as the operating force pushes onto the handle and thus against the click spring and the pressure arm, wherein said force pushes onto the first side of the afore-mentioned rocker. The trigger pushes against the second side of the rocker, specifically at an increasing force at an increasing temperature. As soon as the limit force on the click spring has been exceeded, for example at the afore-mentioned 50 N, the click spring clicks on account of being pushed by the trigger, and releases a specific additional path, specifically the path or the path differential by way of which said click spring has clicked. Said path differential between the basic position and the deflected position of the click spring can be so large that the rocker by the trigger is moved such that said rocker switches off the switching means. When an operator continues to keep the handle depressed while applying the operating force or else an even higher force, it is precisely advantageously provided herein that the afore-mentioned detent means for the handle prevent that the operator quasi pushes the handle onwards also further by the mentioned path differential by way of an operating force which exceeds the triggering force exerted at this point in time by the trigger. By way of an exact configuration, or adjustment, respectively, of the detent means it can be achieved precisely that the rocker is moved, in particular is moved beyond the transition point thereof, and thus opens the switching means again.

While the rocker is advantageously configured so as to be bistable in such a manner that said rocker after clicking is stable in each of the two positions, thus in the free position and in the blocking position, such that said rocker can in each case be moved to the other position only by an external force acting thereon, the click spring should be configured in such a manner that said click spring is stable only in the basic position. This means, that said click spring clicks back on its own or when an operating force of the handle is absent from the deflection position, respectively, in a self-acting manner to the basic position. In this case, said click spring can push by way of restoring force. Said click spring, in the case of an afore-mentioned blocking of the trigger, on the one hand, and the handle, on the other hand, can in this instance quasi again release the path differential mentioned. Said click spring in this instance is configured so as to be monostable.

In a design embodiment of the invention, the pressure arm can have a main body which is configured for the force transmission of the operating force, in particular to the mentioned rocker. Said force transmission is advantageously a compressive force, such that the pressure arm can be precisely configured specifically for transmitting a pressure force. To this end, said pressure arm can be provided with embossed features or the like, and/or a sufficient material thickness. A mounting of the pressure arm in the device can be resilient, and does not have to be performed about a rotary bearing, knife-edge bearing, or the like.

The pressure arm, or the main body thereof, respectively, is advantageously configured as a double bridge having two longitudinal arms which both extend in a rectilinear manner from a mounting, or fastening, respectively, at one end of the pressure arm at which said longitudinal arms are connected in a planar manner to the device, or extend in the longitudinal direction thereof, respectively. The longitudinal arms have at least one transverse arm which connects said longitudinal arms to one another. Said transverse arm can also be so wide that said transverse arm forms a type of transverse face or central face. Two transverse arms can advantageously connect the two longitudinal arms to one another, wherein a spacing of said transverse arms is of such type that a free intermediate space is formed between said transverse arms. The click spring can be fastened to or by way of said intermediate space, or be connected to the main body in such a manner that said click spring is fixedly disposed on said intermediate space, respectively. Said click spring can be to the main body connected in a form-fitting or materially integral manner, said click spring preferably being welded to the latter. The click spring in the deflected position can in this instance optionally engage in the intermediate space.

A mentioned path differential between the basic position and the deflected position can be between 0.5 mm and 4 mm, advantageously between 1 mm and 3 mm.

A bend on the main body, or on the longitudinal arms, respectively, can be provided behind a second transverse arm, or behind the click spring, respectively. Said bend can be between 70° and 110°, advantageously between 80° and 100°. That part of the main body that lies behind said bend can point approximately towards the afore-mentioned rocker, this being considered to be very advantageous for the transmission of a compressive force.

Alternatively, the click spring can also be integrated directly in the transmission means, or in the main body, respectively, such that said click spring is configured in one part and so as to be integral therewith. The main body, conjointly with the click spring, can thus be configured from a sheet metal by a production procedure, wherein the click spring as a curved face can be produced by embossing, for example. In this instance it is considered very advantageous for that region of the main body that is contiguous to the region having the click spring or the click effect, respectively, to be configured in a stable manner, in particular by way of an increased material thickness, material doubling, or bending or folding.

In an advantageous design embodiment of the invention the handle can act directly against the click spring on the transmission means and bear on the latter. Said handle can bear on said click spring, above all when a click spring is configured so as to be planar and curved as described above, so as to be advantageously approximately centric. To this end, a corresponding tappet or the like which can be connected to the handle can be provided.

In a further design embodiment of the invention it can yet be provided for the trigger lever that said trigger lever by way of a spring is at all times pushed against the trigger. Alternatively, said trigger lever, by way of the configuration or fastening, or mounting thereof, respectively, can push in a self-acting manner against the trigger. Any slack which could potentially disturb the mentioned rocker or adversely affect the latter can thus be prevented.

These and further features will emerge not only from the claims but also from the description and from the drawings, wherein the individual features may be realized in each case individually or severally in the form of sub-combinations in an embodiment of the invention and in other fields, and may constitute advantageous and independently protectable embodiments for which protection is claimed here. The division of the application into individual sub-sections and sub-headings does not restrict the statements made here in terms of their general applicability.

BRIEF DESCRIPTION OF THE DRAWINGS

Exemplary embodiments of the invention are schematically illustrated in the drawings and will be explained in more detail hereunder. In the drawings.

DETAILED DESCRIPTION

Figure 1:
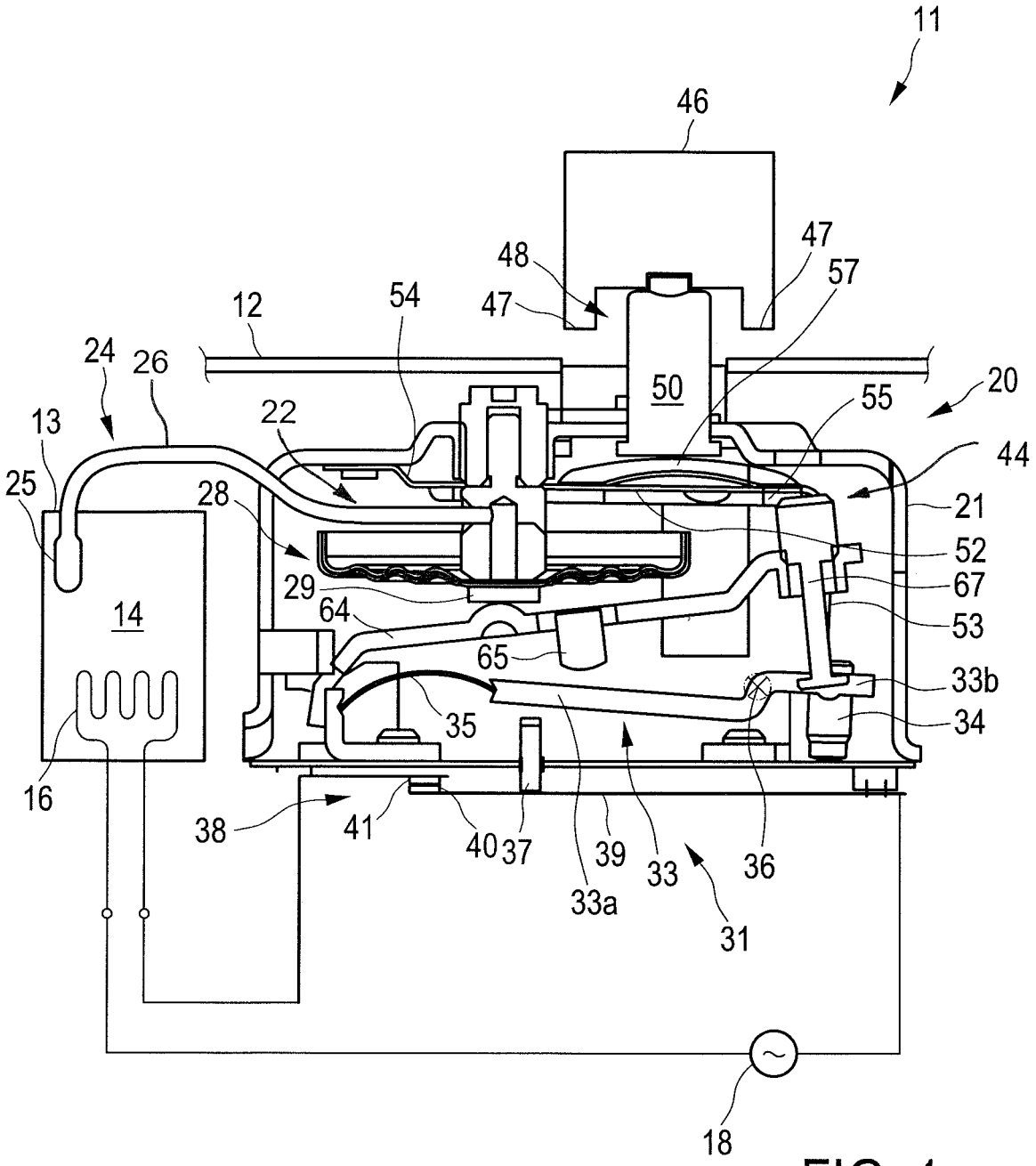
FIG. 1 shows an internal view of a device according to the invention as a limiter in a deep fryer at a low temperature.

A deep fryer 11 as an appliance, or an electrical appliance, respectively, as has been described at the outset is illustrated in FIG. 1 and in a similar manner in FIGS. 2 to 5. The deep fryer 11 in a known manner has a housing 12 and a fry pot 13, a heating device 16 being disposed in the interior space 14 of said fry pot 13, said heating device 16 usually running freely indeed and advantageously being formed by a tubular heating element. Frying fat which is heated by the heating device 16 is filled into the fry pot 13. A current supply 18 for the heating device 16, in which a switch-off device 31 as part of the limiter 20 sits or is integrated in the circuit, is illustrated in a highly simplified manner. A temperature regulator can be additionally provided. In the case of an excessive temperature, the heating device 16 as a safety measure is to be able to be switched off by a temperature sensor device 22 which sits in a housing 21 of the limiter 20. The temperature sensor device 22 in a manner known has a thermo-mechanical temperature sensor 24 which is composed of a short thick sensor 25 and a pipeline 26 connected thereto. An expansion fluid as described above is situated in the hollow sensor 25 as well as in the pipeline 26. The pipeline 26 is in fluid connection to a diaphragm box 28 (i.e., the trigger described at the outset). The diaphragm box 28 or trigger in a manner known can expand downwards, as is shown above all by the comparison with FIG. 2, when a volumetric expansion is performed by virtue of an increasing temperature of the expansion fluid in the temperature sensor 24, said volumetric expansion taking place in this instance precisely also in the diaphragm box 28 and generally causing an expansion of the diaphragm box 28. Since said diaphragm box 28 in an upwards manner is fastened to the housing 21 of the limiter 20, said diaphragm box 28 expands downwards. The actual force of the diaphragm box 28 in this instance is transmitted by a pressure protrusion 29 which is attached to the lower side. All this has been known for some time in the prior art.

The afore-mentioned switch-off device 31 per se is composed mainly of switching means 38 in the form of an elongate and elastic switch spring 39 which is fastened at the right end thereof. Said switch spring 39 is advantageously also electrically contacted at said right end. The switch spring 39 at the left free end supports a contact head 40 by way of which said switch spring 39, on account of the pretensioning thereof, bears so as to push on a counter contact head 41 and closes the contact or the switching means 38, respectively. Since the switching means 38 here are very simple, but a switching procedure by way of the spring-elastic switch spring 39 is to be performed rapidly or abruptly, respectively, a transmission pin 37 is mounted so as to be longitudinally movable in the housing 21, on the one hand. Said transmission pin 37 bears on the switch spring 39 and in some circumstances can also be fastened thereto. The switching means 38 can be opened by means of said transmission pin 37. To this end, the switch-off device 31 has a rocker 33 which by means of a rocker rotation point 36 is mounted in the housing 21, wherein the mounting can be a so-called knife-edge mounting which is known per se. A left rocker arm 33*a* protrudes beyond the transmission pin 37. A rocker spring 35 which is flexed upwards under compressive stress is brought to bear against the end side of said rocker arm 33*a* that points to the left, said end side being notched. Said rocker spring 35 by way of the left end thereof is supported on a mount in the housing 21.

A right rocker arm 33*b* of the rocker 33 is significantly shorter and supports an adjustment screw 34 screwed thereinto. The deflection of the rocker 33 in the position illustrated here, but above all also the activation thereof according to FIG. 4, can be set by way of said adjustment screw 34.

Figure 2:
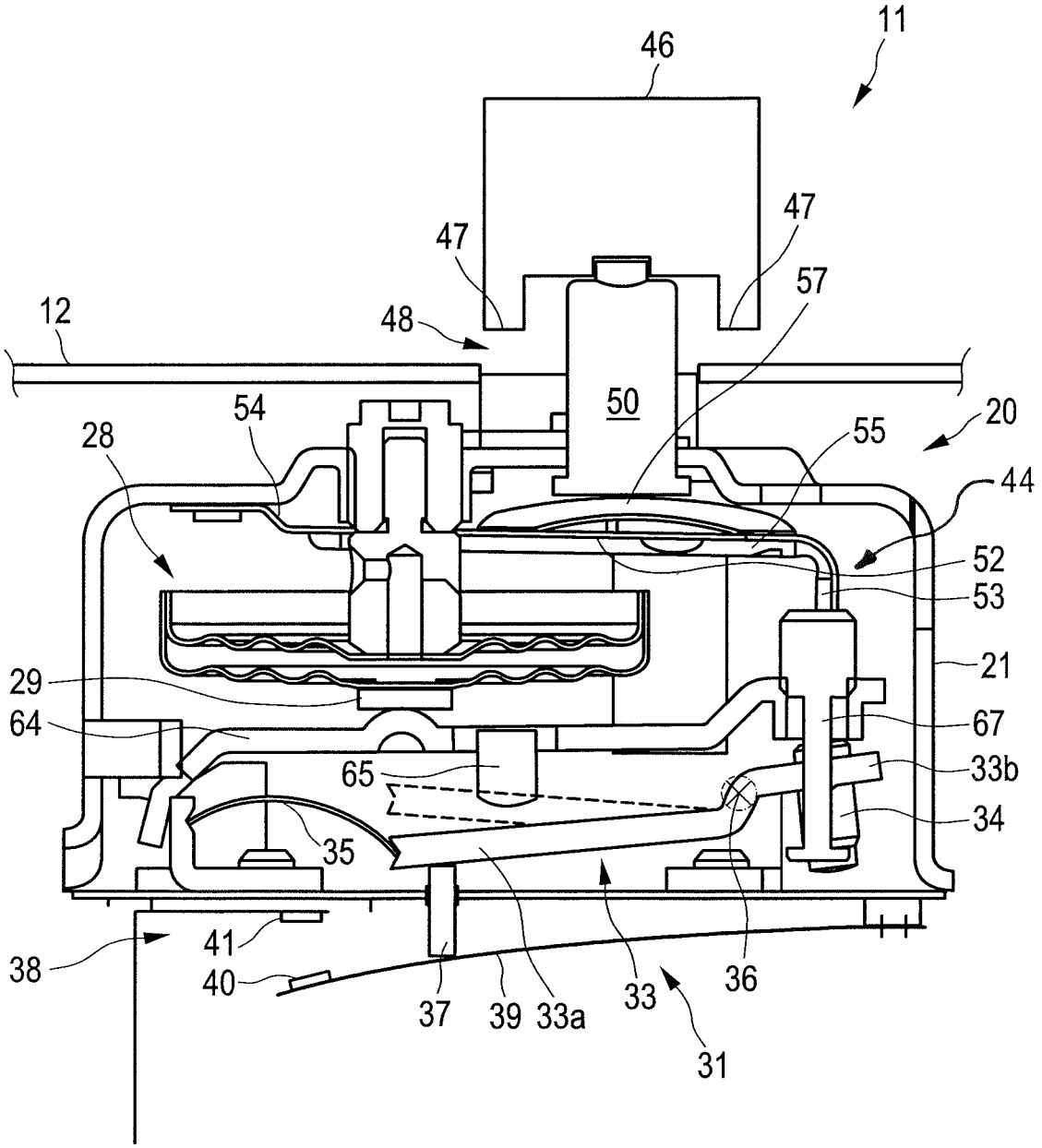
FIGS. 2 to 5 show various functional states of the limiter according to FIG. 1.

Rockers 33 of this type, or the entire switch-off device 31, respectively, for this purpose are also known from the prior art. The rocker 33 is obviously configured so as to be bistable. Said rocker 33 in the free position as a first position illustrated in FIG. 1 is rotated to the maximum towards the right, the adjustment screw 34 bearing on part of the housing 21. An imaginary connecting line can be drawn between the rocker rotation point 36 and the end of the rocker spring 35 bearing on the left, and when the point where the right end of the rocker spring 35 bears on the left rocker arm 33*a* lies above said imaginary line, the rocker is precisely in a free position. When the rocker 33 is moved in a counter-clockwise manner, or when the left rocker arm 33*a* is pushed downwards while correspondingly pivoting the rocker 33, the bearing point of the right end of the rocker spring 35 approximates the afore-mentioned imaginary line. When said bearing point transgresses said line, the rocker 33 in a manner known clicks downwards. Said rocker herein can strike downwards so far until the adjustment screw 34 finds an upwards detent, on the one hand, which will yet be explained in more detail hereunder. Said rocker 33 herein furthermore strikes from above onto the transmission pin 37, striking the latter towards the bottom, on account of which said transmission pin 37 in turn abruptly moves the switch spring 39 downwards so as to separate the contact head 40 and the counter contact head 41. This is illustrated in FIG. 2.

In order for this movement of the rocker 33 now to be caused, a trigger lever 64 which at the left end thereof is pivotally mounted, for example also by way of an afore-mentioned knife-edge mounting, is provided between the rocker 33 and the diaphragm box 28. A downwards-pointing trigger protrusion 65, for example as a tab bent out in a downwards manner, is provided in the trigger lever 64. This trigger protrusion 65 in a movement of the trigger lever 64, or in the downwards pivoting of said trigger lever 64, respectively, pushes on the rocker 33, as described above. To this end reference is also made to FIG. 2.

The trigger lever 64 at the right end has in elongate and screw-fittable trigger detent 67. By way of the latter it can optionally be set how far the trigger lever 64 strikes from below on a part of the housing 21 where the afore-mentioned adjustment screw 34 can also impact in a downwards manner. The trigger lever 64, for example by way of a spring (not illustrated here), can furthermore be pulled upwards, or pivoted in a counter-clockwise manner, respectively, in such a manner that said trigger lever 64 at all times bears on the pressure protrusion 29 of the diaphragm box 28. Said trigger lever 64 can thus not push downwards against the rocker 33 in a self-acting manner and cannot undesirably influence said rocker 33.

When the temperature in the fry pot 13 in the operation of the deep fryer 11 now rises, and the frying fat situated in the interior 14 of said fry pot 13 potentially reaches an excessive temperature, which can become very dangerous for reasons of spontaneous combustion, the temperature sensor device 22 intervenes. The expansion fluid in the sensor 25 and in the pipeline 26 expands specifically by virtue of the increasing temperature and herein in a known manner causes a downwards expansion of the diaphragm box 28 (i.e., the trigger). The pressure protrusion 29 pushes the trigger lever 64 downwards, or pivots the latter in the clockwise manner, respectively. At a specific point herein the trigger protrusion 65 comes to bear on the rocker 33 and pushes said rocker 33 downwards as the diaphragm box 28 increasingly expands. When a transition point as has been previously described of the bistable rocker 33 is exceeded herein, said rocker 33 clicks from the free position to the blocking position which is precisely illustrated in FIG. 2. Said rocker 33 herein has struck the transmission pin 37 downwards, and said transmission pin 37 by way of the switch spring 39 has pushed the contact head 40 away from the counter contact head 41. The switch-off device 31 has thus been activated or switched in order for the heating device 16 to be isolated from the current supply 18 so as to prevent any further heating. As can be seen from the free position of the rocker 33, illustrated in dashed lines in FIG. 2, the rocker 33 between the free position and the blocking position already moves by a certain distance, or by a path, respectively, of approximately 2 mm to 4 mm, on the transmission pin 37. Said two positions can also be set or influenced, respectively, by the adjustment screw 34.

Since the heating device 16 is now switched off, the temperature in the fry pot 13 drops again, this being registered by the temperature sensor device 22. The expansion fluid increasingly contracts, the diaphragm box 28 consequently also being increasingly contracted towards the top. This can be seen in FIG. 3. For the sake of simplicity, the state of the diaphragm box 28 in FIG. 3 corresponds to that of FIG. 1, this however not being therefore mandatory. In any case, it is important to see that the trigger lever 64 is also moved upwards again, or is pivoted in a counter-clockwise manner, according to FIG. 1. If the diaphragm box 28 were to be expanded somewhat more at a somewhat higher temperature than in FIG. 1, and the trigger lever 64 were thus to be pivoted somewhat further in the clock-wise manner, or downwards, respectively, this would however also not change anything. It can be seen from the position of the rocker 33 in the free position (illustrated in dashed lines) that the trigger protrusion 65 of the trigger lever 64 would still be significantly thereabove and thus would not affect the rocker 33.

However, the rocker 33, by virtue of the bistable design embodiment thereof, remains so as to be pushed downwards in the blocking position according to FIG. 2. On account thereof, the switching means 38 also remains forcibly opened, or a spring force of the switch spring 39 is significantly insufficient in order for the rocker 33 by way of the transmission pin 37 to be pushed upwards beyond the transition point of said rocker 33. This is precisely also the intention; after all, the limiter 20 operates in a different manner than a pure temperature regulator. The intervention of the limiter 20, or the switching-off of the switching means 38, respectively, as a safety measure is specifically to have the effect that manual reactivation or re-switching on, respectively, is necessary. Ultimately, an operator is intended to personally check directly and reliably whether a dangerous operating state has not potentially arisen at the deep fryer 11.

Figure 4:
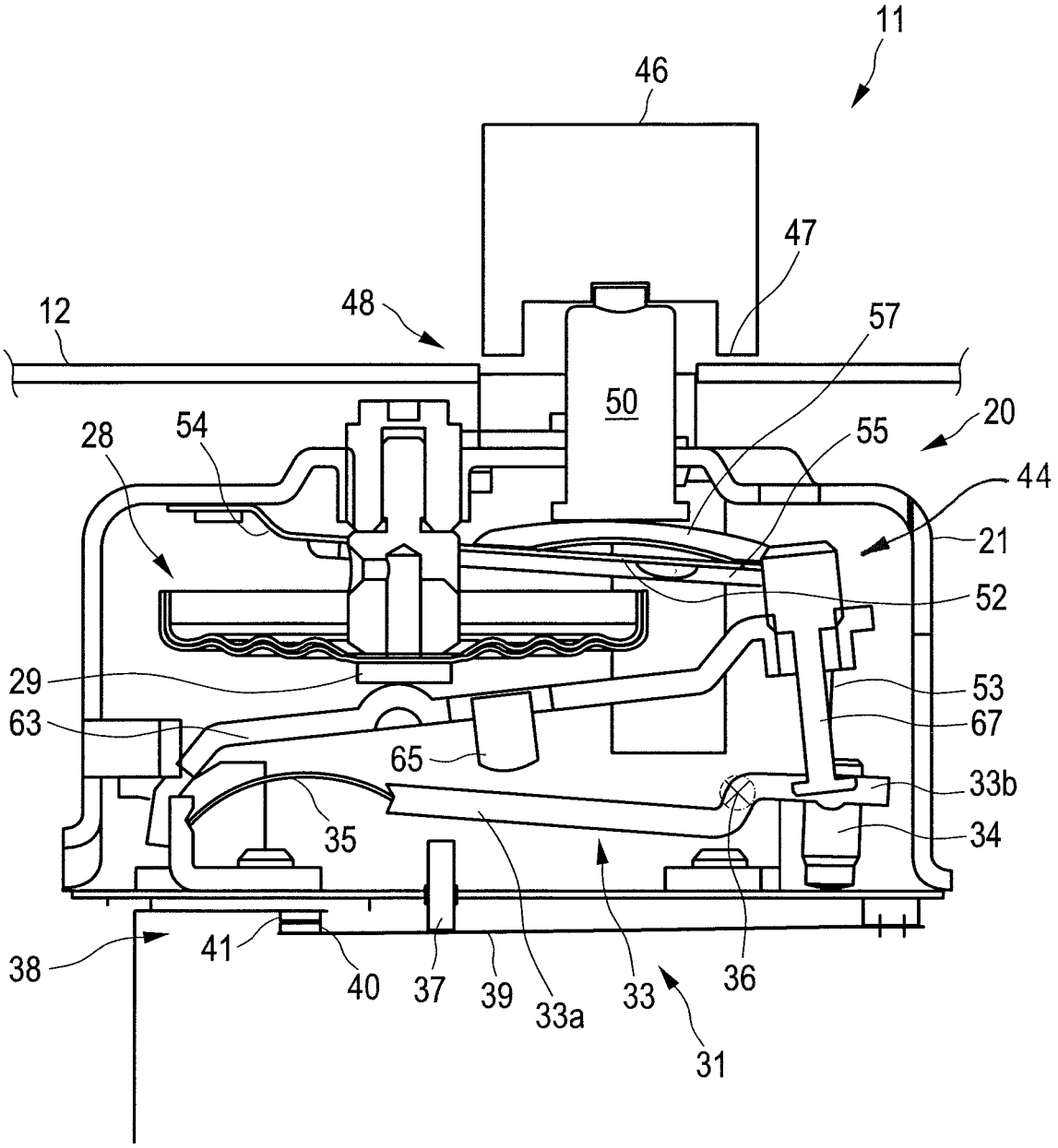

The operator for renewed switching-on of the heating can now activate reactivation means 44 and to this end push a pushbutton 46 (i.e., a movable handle), as is visualized in FIG. 4. The pushbutton 46 has an encircling detent ring 47 which points downwards towards the housing 12 and which causes a maximum depression capability. The latter here in FIG. 4 has however not yet been reached. A transmission means 48 according to the invention is provided in or on the pushbutton 46. The transmission means 48 have a tappet 50 which is connected to the pushbutton 46.

Figure 3:
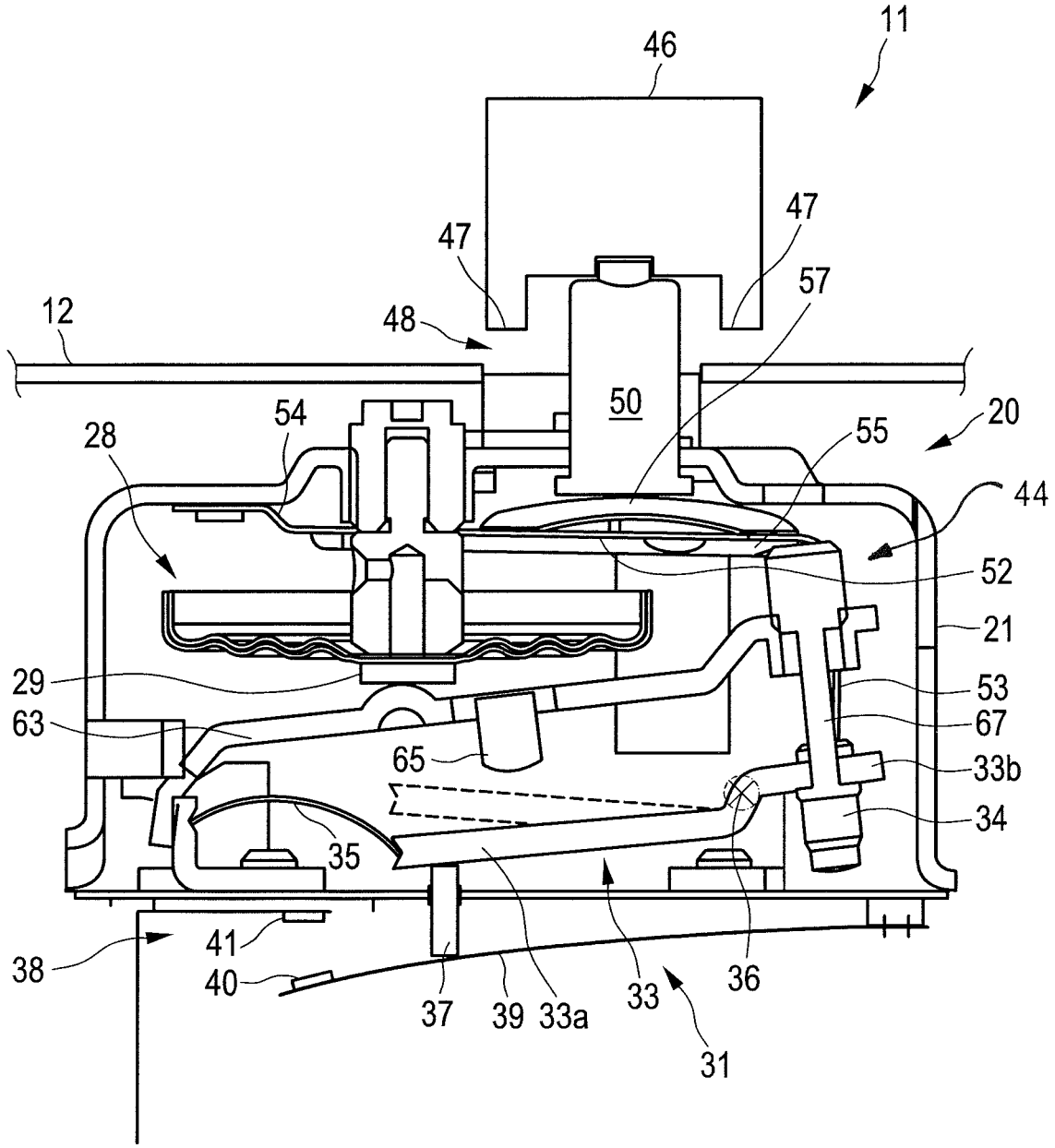

As can be seen from the comparison of FIG. 3 and FIG. 4, the tappet 50 in this instance pushes downwards onto a pressure arm 52 which at the left end thereof is connected to the housing 21 of the limiter 20, or pivots said pressure arm 52 in the clock-wise manner about the bearing point. The pressure arm 52, in a manner similar to the rocker 33 and the trigger lever 64, is configured so as to be relatively stable and indeed inflexible. Said pressure arm 52 can indeed be composed of a relatively thin sheet metal, as can be seen at the extreme left, but for enhanced stability in a manner known has corrugations or embossed features, respectively, as will be explained hereunder in the context of FIGS. 6 to 9. Pushing the pressure arm 52 downwards by the tappet 50 has the effect that a pressure arm end 53 which is angled to the right in a downwards manner and which can also be seen in FIG. 1, is pushed downwards, the adjustment screw 34 in the rocker 33 also bearing on the lower end of said pressure arm end 53. This proceeds so far that the rocker 33 is again pivoted in the clock-wise manner, and the left rocker arm 33*a* is moved beyond the dead centre in an upwards manner, such that the rocker 33, activated by the rocker spring 35, strikes upwards. The adjustment screw 34, according to FIG. 1, in this instance, impacts in a downwards manner, this corresponding to the free position. The pressure arm end 53 of the pressure arm 52 furthermore pushes against the adjustment screw 34, or pushes the latter downwards, respectively, in the case of the operator continuing to push the pushbutton 46. A further movement in this direction is not possible on account of the adjustment screw 34 impacting in a downwards manner.

The pressure arm 52 at the left end has a spring region 54. The spring region 54 pushes the pressure arm 52 upwards, or causes a rotation in a counter-clockwise manner, respectively. This is achieved by the inherent material elasticity; the pressure arm 52 is advantageously composed of spring-elastic sheet metal.

It can be seen from FIG. 4 that the transmission pin 37 has been released by the rocker 33, and the switch spring 39 can again push said transmission pin 37 upwards and above all, by way of the contact head 40, can again bear on the counter contact head 41. The switching means 38 is thus closed again, and the heating device 16 can operate again.

As is, a purposeful and safe state could have now been re-established, and the deep fryer 11 could continue to safely operate again, respectively. However, a look at FIG. 4 shows that there is the issue of a blockage now arising at a renewed temperature increase by way of the expansion of the diaphragm box 28 and the downwards movement of the pressure protrusion 29 and the trigger lever 64. The trigger lever 64 would indeed attempt to push the rocker 33 downwards again by way of the trigger protrusion 65. However, the rocker 33 per se cannot move because the activated reactivation means 44, or the pushbutton 46 held depressed by the operator, respectively, prevent this by way of the force transmission via the transmission means 48 on the pressure arm 52. Specifically, the right rocker arm 33*b* having the adjustment screw 34 is firmly pressed downwards by the pressure arm 52, or the upwards path of said right rocker arm 33*b* is blocked, respectively. In order for no damage to arise herein and the functioning of the limiter 20 counter to an excessive temperature to nevertheless be able to be ensured, a click spring 57 is provided in the transmission means 48 (cf. also FIGS. 6 to 9).

Figure 5:
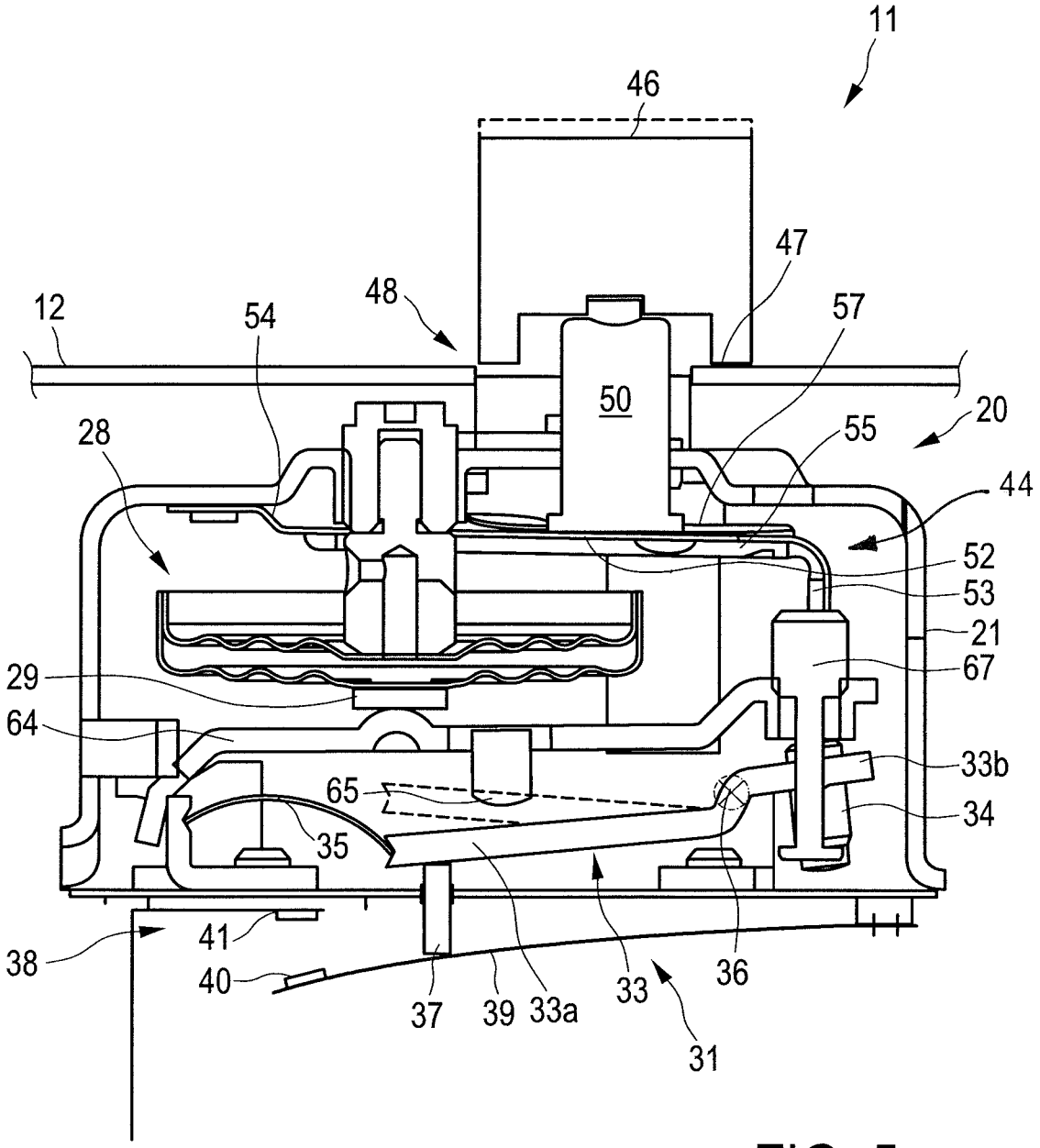
Figure 6:
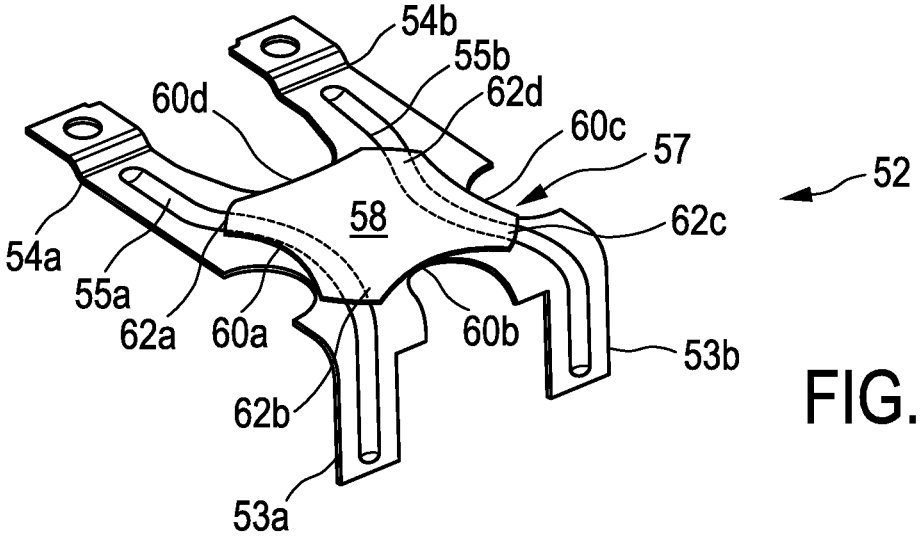
FIG. 6 shows an enlargement of a pressure arm having a click spring in the non-depressed state as the basic position, in an oblique illustration.
Figure 7:
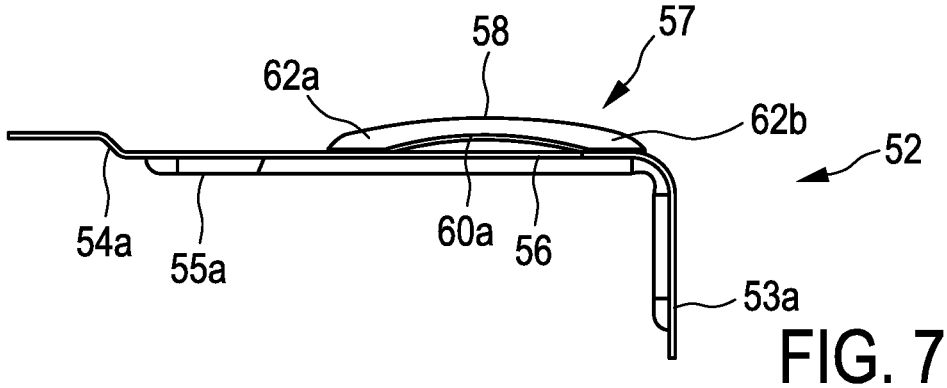
FIG. 7 shows the pressure arm from FIG. 6 in a side view.
Figure 8:
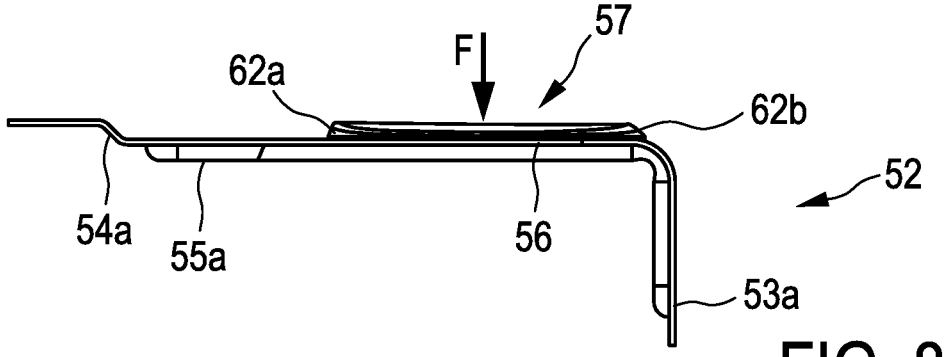
FIG. 8 shows the pressure arm from FIG. 7 having the click spring in the depressed state as the deflected position.

As can be seen from FIG. 5, and as is shown in detail in FIGS. 6 to 8, the trigger lever 64 in the case of an expanding diaphragm box 28 pushes the rocker 33, or the left rocker arm 33*a*, respectively, downwards such that the right rocker arm 33*b* is pushed upwards. Pressure is thus transferred by way of the pressure arm end 53 onto the pressure arm 52 which by way of the click spring 57 pushes against the tappet 50 from below. However, since the operator continues to push the pushbutton 46 from the front, or even pushes the latter against the housing 12, respectively, such that the detent ring 47 bears on the front side of the housing 12, the tappet 50 cannot be pushed out of the limiter 20. The risk of damage would therefore exist here, since the diaphragm box 28 continues to expand since the heating device 16 continues to operate, or is not yet switched off, respectively, and the two forces oppose one another. The force for clicking the click spring 57 as the limit force is however now chosen in such a manner as has been explained at the outset, that said click spring is depressed at a force of approximately 50 N, for example, and herein clicks downwards. This can be seen from the comparison of FIGS. 7 and 8, wherein FIG. 7 corresponds to the state of FIG. 4, and FIG. 8 corresponds the state of FIG. 5.

In this downwards clicking of the click spring 57 a path of approximately 1 mm to at most 4 mm is traveled as soon as the click spring 57 after exceeding the transition point thereof clicks downwards to the deflected position. The diaphragm box 28 can now continue to expand, or by way of the pressure protrusion 29 move downwards without having to be pushed counter to a strong force. The click spring 57, configured so as to be monostable, by way of the restoring force thereof does indeed attempt once more to return to the original shape thereof according to FIG. 7. However, said force can be significantly lower, for example can be 10 N to 30 N, this causing only a minor stress to the participating parts in the force transmission, specifically to the trigger lever 64, the rocker 33, and the pressure arm 52.

The restoring force of the click spring 57 can even be so minor that said restoring force, in the case of the chosen lever ratios and the design embodiment of the rocker spring 35, is not sufficient for the right rocker arm 33*b* to be pushed downwards counter to the force of the rocker spring 35. The rocker 33, after the left rocker arm 33*a* has been pushed downwards by the trigger protrusion 65 of the trigger lever 64 by virtue of the expansion of the diaphragm box 28, thus remains in the position according to FIG. 5. Specifically, the left rocker arm 33*a*, on account of said expansion of the diaphragm box 28, has been struck downwards, on account of which the transmission pin 37 has separated the switching means 38. The state of FIG. 5 can be present immediately thereafter.

As can also be seen from FIG. 5, the heating device 16 is switched off, and the diaphragm box 28, by virtue of the temperature now dropping, retracts upwards again, accompanied by a corresponding movement of the trigger lever 64 in a counter-clockwise manner. However, the bistable rocker 33 remains in the blocking position illustrated in FIG. 5, despite the operator continuing to push the pushbutton 46, or pushing the latter against the front side of the housing 12. The restoring force of the click spring 57 alone does indeed not suffice in order for the rocker spring 35 to be overcome.

It is only when an operator releases the pushbutton 46 that the latter can jump out to the position illustrated in dashed lines, specifically because the monostable click spring 57, by way of a central region 58 on which the lower side of the tappet 50 bears, then jumps upwards in a self-acting manner. The state of FIG. 2 is then present, specifically also having opened switching means 38. An operator can only now again push the pushbutton 46 for reactivating or re-switching on, respectively, the switching means 38, as has already been explained in the context of FIG. 2. The force of the click spring 57 as a limit force required for depressing is specifically higher than the force which is required for pushing the right rocker arm 33*b* downwards and for pivoting the rocker 33 in the clock-wise manner, counter to the force of the rocker spring 35. This has been explained above.

The click spring 57 on the pressure arm 52 can be better seen in FIGS. 6 and 7. The pressure arm 52 has two pressure arm ends 53*a* and 53*b* which are bent downwards and reach up to a main body 56. In the other direction, the spring regions 54*a* and 54*b* proceed in a similar manner from the main body 56, said spring regions 54*a* and 54*b* in this instance being fastened to the housing 21 of the limiter 20 from below, according to FIG. 1. In each case one embossed feature 55*a* and 55*b*, respectively, extends from the spring regions 54*a* and 54*b* through the main body 56 into the pressure arm ends 53*a* and 53*b*. Said embossed features 55*a* and 55*b* can be seen in FIG. 7 and impart the entire pressure arm 52 with stability against flexing.

The click spring 57 is placed on top of the main body 56, or is fastened thereabove. The click spring 57 has a curved central region 58 and four peripheral concavities 60*a* to 60*d* which therebetween have in each case one bearing foot 62*a* to 62*d*. The click spring 57 by means of said bearing feet 62*a* to 62*d* is fastened, advantageously welded, to the pressure arm 52 in the region of the main body 56.

The side views of FIGS. 7 and 8 show how the click spring 57 in the basic position in FIG. 7 is curved upwards by way of the central region 58. It can be seen how the bearing feet 62*a* and 62*b* by way of a peripheral concavity 60*a* therebetween bear on top of the pressure arm 52 in the region above the main body 56. Said bearing feet 62*a* and 62*b* can be fixedly welded here. The entire pressure arm 52, despite being composed of a relatively spring-elastic material, is stabilized by the elongate embossed features 55*a* and 55*b*.

When a force F as aforementioned operating force, illustrated in FIG. 8 by the solid arrow, now pushes from above onto the central region 58 on the click spring 57, and when the pressure arm end 53 cannot yield downwards, the click spring 57 strikes downwards as soon as the operating force F exceeds the afore-mentioned limit force of, for example, approximately 50 N. As can be seen, a path of a few millimetres, here advantageously 1 mm to 4 mm, is traveled here. Since the click spring 57 is configured so as to be monostable, said click spring 57 in the absence of the force F would immediately click upwards again, or by way of an afore-mentioned restoring force push upwards, respectively. Said restoring force is significantly lower than the force required for clicking downwards and can be, for example, 10 N to 30 N. This arrow of the operating force directly aims at and goes through the click spring 57.

Figure 9:
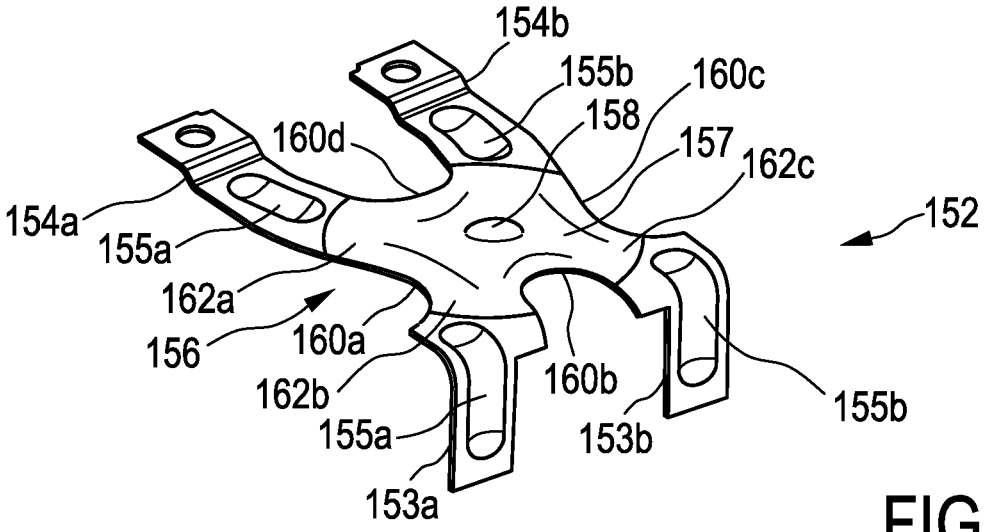
FIG. 9 shows a pressure arm of an alternative configuration, having an integrated click spring in an illustration similar to that of FIG. 6.

A modification of a pressure arm 152 which also has two pressure arm ends 153*a* and 153*b* which point downwards towards the right and which are brought together in a main body 156 is illustrated in FIG. 9. Embossed features 55*a* and 55*b* terminate ahead of said main body 156. Two spring regions 154*a* and 154*b* which in each case also have embossed features 155*a* and 155*b* proceed from the main body 156 in the other direction. The main body 156 per se forms the click spring 157 here, or is configured in a corresponding manner, respectively, and is above all curved upwards having an elevated central region 158 which here is indicated by corresponding indicator lines. Said click spring 157 also has four peripheral concavities 160*a* to 160*d*, because outriggers 162*a* to 162*d* are configured therebetween.

The design embodiment of such an integration of the pressure arm 152 and the click spring 157 in terms of construction and production is not that simple, but has the great advantage of greater integration. The welding of the click spring 57 to the main body 56, or to the pressure arm 52, respectively, according to FIGS. 6 to 8 can be dispensed with in this instance. The force ratios of the click spring 157 are advantageous in a manner similar to that explained above; said click spring 157 is likewise also preferably configured so as to be monostable. Said click spring 157 in this instance does not have to be reset, this under certain circumstances potentially being difficult in mechanical and technical terms also.

The object of a permanent blockage of the switching-off of the heating device 16 in the deep fryer 11, potentially desired by an operator, being suppressed even when the pushbutton 46 for reactivating the switching means 38 is permanently depressed, or is held up to the detent, respectively, can thus be achieved by way of the invention. Appliance safety is thus maintained at all times.

That which is claimed:

1. A temperature-controlled device for switching off a heating device at a certain limit temperature, said temperature-controlled device having:

a thermo-mechanical temperature sensor device;

a switch-off device, manual reactivation means, wherein said thermo-mechanical temperature sensor device has:

a thermo-mechanical temperature sensor;

a trigger, wherein said switch-off device has switching means that, are activatable and switchable by said trigger, wherein said switching means is configured for installation in a path of an energy supply to said heating device, wherein said manual reactivation means has:

a movable handle for transmitting an operating force of an operator for reactivating said switching means or re-switching on said switching means after switching off said switching means by said trigger;

transmission means between said movable handle and said switching means, said transmission means being connected in a force-transmitting manner to said movable handle, wherein said transmission means has a click spring which in said line of said operating force that acts thereon from said movable handle, up to a certain limit force, is in a basic position as a first position and, when said operating force acting on said click spring exceeds said limit force, clicks to a deflected position as a second position;

said click spring in said basic position reactivates said switching means or re-switches on said switching means;

said click spring in said deflected position has a movement path on said transmission means for said switching means that said switching means by said thermo-mechanical temperature sensor device and by said switch-off device at a temperature above said limit temperature are activatable and switchable again for switching off said heating device by said trigger;

wherein a trigger force exerted by said trigger in said temperature-controlled device acts counter to said operating force exerted on said movable handle by said operator, wherein said click spring is disposed in said force path between said trigger force and said operating force; and wherein a path differential between said basic position and said deflected position on said click spring is such that when said limit temperature is exceeded, said trigger exerts a trigger force on a trigger lever and a rocker so that said rocker moves counter to said click spring to switch off said switching means.

2. The temperature-controlled device according to claim 1, wherein a detent ring for a maximum movement path relative to said temperature-controlled device is provided for said movable handle.

3. The temperature-controlled device according to claim 2, wherein said detent ring is configured to extend from said movable handle towards a housing of said temperature-controlled device and at least partially engage across said transmission means.

4. The temperature-controlled device according to claim 1, wherein said click spring is planar or curved in one direction.

5. The temperature-controlled device according to claim 1, wherein said click spring is monostable, wherein said basic position is a stable position.

6. The temperature-controlled device according to claim 1, wherein said click spring is configured in such a manner that said limit force is less than said trigger force which has been generated by said trigger at a temperature beyond said limit temperature.

7. The temperature-controlled device according to claim 1, wherein said movable handle acts against and bears on said click spring.

8. The temperature-controlled device according to claim 7, wherein said movable handle is provided at a center of said click spring, wherein said click spring is planar or curved in one direction.

9. The temperature-controlled device according to claim 1, having a pressure arm, wherein said rocker has a rocker rotation point, and wherein said pressure arm is configured so as to be pivotable and is mounted in such a manner that said handle by way of said operating force acts on said pressure arm so as to move said pressure arm, wherein said pressure arm, when reactivating or re-switching on, is pushed against said rocker, wherein said rocker, by way of movement thereof, releases a movement path for said switching means so as to thus be able to close said switching means.

10. The temperature-controlled device according to claim 9, wherein said rocker is configured so as to be bistable and in a free position as a first position that does not activate said switching means is not influenced by said rocker, wherein said rocker in a blocking position as a second position forcibly opens said switching means and keeps said switching means opened.

11. The temperature-controlled device according to claim 9, wherein said trigger acts on said trigger lever by way of an increasing deflection of said trigger lever as said temperature rises at said thermo-mechanical temperature sensor, wherein said trigger lever is disposed between said trigger and said switching means.

12. The temperature-controlled device according to claim 11, wherein said trigger lever is disposed between said trigger and said rocker.

13. The temperature-controlled device according to claim 12, wherein said trigger lever, at an increasing temperature at said temperature sensor, pushes against said rocker in such a manner so as to push said rocker from said free position to said blocking position.

14. The temperature-controlled device according to claim 9, wherein said pressure arm has a main body which is configured for a force transmission of said operating force, wherein said operating force is a compressive force.

15. The temperature-controlled device according to claim 14, wherein said main body is configured as a double bridge having two longitudinal arms which extend in each case from an end, where said longitudinal arms are connected to said temperature-controlled device, wherein said longitudinal arms for connection therebetween have at least one transverse arm.

16. The temperature-controlled device according to claim 15, wherein said at least one transverse arm comprises two transverse arms that have a mutual spacing that is provided between said two longitudinal arms in such a manner that a free intermediate space is formed between said two transverse arms and said two longitudinal arms, wherein a bend of 70° to 110° is provided behind one of said two transverse arms or behind said click spring.

17. The temperature-controlled device according to claim 14, wherein said click spring is integrated in said transmission means in such a manner that said transmission means, said click spring and said main body are integrally formed by a sheet metal.

18. The temperature-controlled device according to claim 14, wherein said click spring is connected to said transmission means in such a manner that said click spring is connected to said main body in a form-fitting or materially integral manner.

* * * * *